United States Patent [19]

Reed, Jr. et al.

[11] 4,023,995

[45] May 17, 1977

[54] EXTINGUISHABLE PROPELLANT COMPOSITION

[75] Inventors: Russell Reed, Jr., Ridgecrest, Calif.; Richard P. Cornia, Logan, Utah

[73] Assignee: Thiokol Corporation, Newtown, Pa.

[22] Filed: Sept. 11, 1975

[21] Appl. No.: 612,336

[52] U.S. Cl. ..... 149/19.3; 149/76; 149/108.8; 149/113

[51] Int. Cl.[2] ..... C06B 45/10; C06B 29/22; C06B 25/02

[58] Field of Search ..... 149/19.3, 76, 108.8, 149/113

[56] References Cited

UNITED STATES PATENTS

| | | | |
|---|---|---|---|
| 3,235,421 | 2/1966 | Berenbaum | 149/19.3 |
| 3,235,422 | 2/1966 | Stang | 149/19.3 |
| 3,255,059 | 6/1966 | Hamermesh | 149/19.3 |
| 3,565,706 | 2/1971 | Waite | 149/19.3 |
| 3,632,458 | 1/1972 | Filter | 149/19.3 |

*Primary Examiner*—Samuel W. Engle
*Assistant Examiner*—Donald P. Walsh

[57] ABSTRACT

A solid rocket propellant composition having a relatively high low pressure deflagration limit (Pdl) and thereby capable of being extinguished with only a relatively small drop in combustion chamber pressure. The composition comprises a major amount of finely divided ammonium perchlorate and a minor amount of fluoroalkyl acrylate or methacrylate polymer as a binder, the weight ratio being from about 4.5:1 to about 6:1.The fluidity of the composition prior to curing can be improved by incorporating a small amount of an acrylate or methacrylate having an oxygen-containing functional group, e.g., hydroxyalkyl, epoxyalkyl and glycerol acrylates and methacrylates.

12 Claims, No Drawings

EXTINGUISHABLE PROPELLANT COMPOSITION

This invention relates to solid rocket propellants, and more particularly, to a solid rocket propellant capable of being readily extinguished and subsequently re-ignited.

While conventional solid rocket propellants provide important advantages over liquid propellants for certain applications, they are in general subject to the disadvantage that once they are ignited, they cannot readily be extinguished and re-ignited. Since there are numerous rocket applications wherein it is desirable or necessary to start and stop the rocket motor one or more times, the difficulties encountered in extinguishing and re-igniting solid propellant rockets constitute a serious limitation on their utility.

It is known that solid propellants burning in a rocket casing at an elevated pressure can be extinguished by an abrupt reduction in the pressure within the casing. The ability of a solid propellant to be extinguished in this manner can be conveniently evaluated in terms of its low pressure deflagration limit (Pdl). This limit is defined as the pressure at which burning of the propellant ceases when it is subjected to a relatively low specified pressure decay rate. In order to achieve rapid extinction the Pdl value of a propellant should desirably be of the order of 30 to 200 psia.

It is an object of the present invention to provide a solid propellant composition that can be readily extinguished and re-ignited. It is another object of the invention to provide a solid propellant having a relatively low burning rate and a relatively high low pressure deflagration limit (Pdl), say 50 psia or greater. It is still another object of the invention to provide an extinguishable solid propellant composition having processing properties which permit it to be conveniently mixed and cast in fluid form and subsequently cured at an elevated temperature. It is a still further object of the invention to provide an extinguishable solid propellant having good mechanical properties. Other objects of the invention will be in part obvious and in part pointed out hereafter.

The objects of the present invention are achieved in general by preparing an intimate mixture of finely divided oxidizer, preferably ammonium perchlorate, and liquid curable fluorocarbon binder, casting the mixture in a desired configuration and curing it at an elevated temperature. The preferred liquid fluorocarbons used as binders in the present compositions are fluoroalkyl acrylates and methacrylates of the general formula

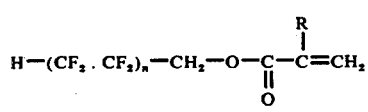

wherein R is hydrogen or methyl and $n$ is 1 to 4.

As conducive to a clearer understanding of the present invention, it may be pointed out that solid propellants comprising ammonium perchlorate as an oxidizer and a fluorocarbon binder to provide a high density propellant are known in the art and are disclosed, for example, in U.S. Pat. Nos. 3,235,422, 3,255,059 and 3,565,706. However, the disclosures of these prior patents do not deal with the problems of providing an extinguishable propellant.

It has been found that in order to achieve the combination of acceptable processing and mechanical properties, as well as a low burning rate and a relatively high extinction pressure, the relative proportions of oxidizer and liquid fluorocarbon binder must be kept within rather narrow limits. More particularly, the weight ratios of ammonium perchlorate to binder should be in the range of about 4.5:1 to about 6:1, i.e., about 14 to 18% by weight of binder and 82 to 86% of ammonium perchlorate. Also as indicated in the specific Examples given below, the ammonium perchlorate should have a particle size distribution that reduces the void space between the particles to a relatively low value. If the ammonium perchlorate/binder ratio is increased above 6:1 with such a particle size distribution, the consistency of the mixture is not sufficiently fluid to permit rapid and thorough mixing and acceptable casting. On the other hand, if the ratio is below about 4.5, the propellant has inferior flame extinction properties.

It has been further found that the processing properties of the compositions, in particular the fluidity of the uncured compositions for a given ratio of ammonium perchlorate to fluorocarbon binder, can be improved by incorporating in the binder a small amount of an acrylate or methacrylate having an oxygen-containing functional group. Suitable acrylates for this purpose are hydroxyalkyl, epoxyalky, and glycerol acrylates and methacrylates, and mixtures thereof. It appears that the acrylates having oxygen-containing functional groups, when incorporated in the binder as described below, may be preferentially adsorbed on the surfaces of the ammonium perchlorate particles. In any event, the presence of a small amount of such acrylates in the mixture reduces its viscosity significantly, improves its mixing properties and castability, and also improves the mechanical properties of the cured composition.

It has been still further found that the rheological properties of the uncured castable composition and its uniformity can be improved by incorporating therein a minor amount of a high molecular weight fluorocarbon polymer. A copolymer of hexafluoropropylene and vinylidene fluoride sold under the trade designation "Viton A" is suitable for this purpose. Such a polymer promotes stable dispersion of the particulate ammonium perchlorate in the liquid binder during preparation, casting and curing of the propellant composition.

Curing of the composition is effected by polymerizing the acrylate binder components through the ethylenically unsaturated groups thereof, using conventional free radical catalysts such as, for example, benzoyl peroxide, dicumyl peroxide, tertiary butyl perbenzoate or cumene hydroperoxide. Curing can be effected at temperatures of say 120° to 135° F. for periods of several hours to several days.

The preferred ranges of proportions of the binder components on a weight basis are as follows:

| Component | Weight % |
|---|---|
| Liquid fluoroacrylate | 86 to 95% |
| High molecular weight fluorocarbon polymer | 5 to 14% |
| Acrylate monomer with oxygen-containing functional groups | 0.1 to 5% |
| Polymerization catalys | 0.1 to 5% |

The mixing, de-aerating, casting and curing of the present compositions may be effected by the conventional procedures known in the art.

In order to point out more fully the nature of the present invention, the following specific Examples are given of formulations embodying the invention.

EXAMPLE 1

A propellant formulation was made by mixing the following ingredients in the indicated proportions, the percentages being given by weight.

| | |
|---|---|
| 1,1,7-trihydrododecafluoroheptyl acrylate | 14.69% |
| High molecular weight fluorocarbon polymer (Viton A) | 1.11 |
| 2-hydroxypropyl acrylate | 0.05 |
| Glycidyl methacrylate | 0.05 |
| Benzoyl peroxide | 0.10 |
| Ammonium hexafluorophosphate | 1.00 |
| Ammonium perchlorate | |
| 200 micron 45 | |
| 45 micron 22 | |
| 3 micron 16 | 83 |

The high molecular weight fluorocarbon polymer was dissolved in the 1,1,7-trihydrododecafluoroheptyl acrylate and the resulting solution was mixed with the benzoyl peroxide and the other liquids, namely, the hydroxypropyl acrylate and the glycidyl methacrylate. Thereafter the ammonium hexafluorophosphate and the ammonium perchlorate were added to and mixed with the composition.

To facilitate admixture of the ammonium perchlorate with the pre-mixed liquids, the temperature of the formulation was increased to 110° to 115° F. and near the end of the mixing period, to 125° F. Mixing was carried out over a period of about an hour. At the end of this time the viscosity of the mix was about 7 Kps.

Upon completion of the mixing the composition was cast and cured. Curing was effected at about 135° F. over a period of 24 hours. After curing the following properties were measured:

| | |
|---|---|
| Pdl | 120 |
| E modulus (psi) | 1200 |
| $\sigma_m$ stress (psi) | 153 |
| $\epsilon_m^t$+ strain at maximum stress (%) | 30 |
| $\epsilon_R^t$ strain at rupture (%) | 60 |

EXAMPLE 2

A propellant formulation was made by mixing the following ingredients in the indicated percentages by weight:

| | |
|---|---|
| 1,1,7-trihydrododecafluoroheptyl acrylate | 14.47% |
| High molecular weight fluorocarbon polymer (Viton A) | 1.43 |
| Benzoyl peroxide | 0.10 |
| Ammonium perchlorate | |
| 200 micron 46 | |
| 90 micron 10 | |
| 45 micron 12 | |
| 3 micron 16 | 84 |

The mixing, casting and curing steps were carried out as in Example 1. The viscosity of the uncured mixture prior to casting was 34 Kps at 124° F. The cured product exhibited the properties given below.

| | |
|---|---|
| Pdl | 146 |
| E modulus (psi) | 1700 |

-continued

| | |
|---|---|
| $\sigma_m$ stress (psi) | 167 |
| $\epsilon_m^t$+ strain at maximum stress (%) | 9 |
| $\epsilon_R^t$ strain at rupture (%) | 40 |

From the foregoing description it should be evident that the present invention provides a propellant composition capable of achieving the objectives listed above. The compositions have a relatively high low pressure deflagration limit. Also by using acrylates having an oxygen-containing functional group, the fluidity of the uncured composition can be substantially reduced and mixing of the ingredients thereby facilitated.

It is of course to be understood that the foregoing Examples are intended to be illustrative only and that numerous changes can be made in the ingredients, proportions and conditions set forth therein without departing from the scope of the invention as set forth in the appended claims.

We claim:

1. A self-extinguishing propellant composition having a low pressure deflagration limit of 30 to 200 p.s.i.a. and comprising particulate ammonium perchlorate and a binder in a weight ratio of about 4.5:1 to about 6:1, said binder being a polymer consisting essentially of fluoroalkyl acrylate or methacrylate units polymerized through the ethylenic groups thereof, said binder being the sole flame retardant component of said composition.

2. A propellant composition according to claim 1 wherein the binder is a polymer of a fluoroalkyl acrylate or methacrylate of the general formula

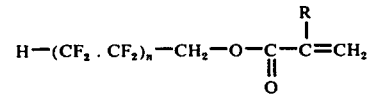

wherein R is hydrogen or methyl and *n* is 1 to 4.

3. A composition according to claim 1 wherein said binder is a polymer of 1,1,7-trihydrododecafluoroheptyl acrylate.

4. A castable propellant composition curable at an elevated temperature to form a self-extinguishing propellant having a low pressure deflagration limit of 30 to 200 p.s.i.a. and comprising an intimate mixture of particulate ammonium perchlorate and a binder in a weight ratio of about 4.5:1 to about 6:1, said curable binder consisting essentially of a liquid fluoroalkyl acrylate or methacrylate of the general formula

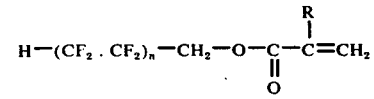

wherein R is hydrogen or methyl and *n* is 1 to 4, said binder being the sole flame retardant component of said composition.

5. A curable composition according to claim 4 containing from 5 to 14% by weight, based on the weight of said binder, of a higher molecular weight fluorocarbon polymer to maintain said ammonium perchlorate suspended in said liquid acrylate during preparation and curing of said curable composition.

6. A castable propellant composition curable at an elevated temperature to form a self-extinguishing propellant having a low pressure deflagration limit of 30 to 200 p.s.i.a. and comprising an intimate mixture of particulate ammonium perchlorate and a polymerizable binder in a weight ratio of about 4.5:1 to about 6:1, said polymerizable binder consisting essentially of a major amount of a first acrylate monomer of the general formula

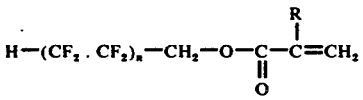

wherein R is hydrogen or methyl and $n$ is 1 to 4, and a minor amount of a second acrylate monomer selected from hydroxyalkyl, epoxyalkyl and glycerol acrylates and methacrylates and mixtures thereof, said binder being the sole flame retardant component of said composition.

7. A composition according to claim 6 wherein said first monomer is 1,1,7-trihydrododecafluoroheptyl acrylate and said second monomer is a mixture of 2-hydroxypropyl acrylate and glycidyl methacrylate.

8. A composition according to claim 6 containing from 5 to 14% by weight, based on the weight of said polymerizable binder, of a high molecular weight fluorocarbon polymer to maintain said ammonium perchlorate in suspension in said binder during preparation and curing of said mixture.

9. A composition according to claim 8 wherein said high molecular weight polymer is a copolymer of hexafluoropropylene and vinylidene fluoride.

10. A castable propellant composition curable at an elevated temperature to form a self-extinguishing propellant having a low pressure deflagration limit of 30 to 200 p.s.i.a. and consisting essentially of an intimate mixture of particulate ammonium perchlorate and liquid polymerizable binder in a weight ratio of about 4.5:1 to about 6:1, said polymerizable binder consisting essentially of from about 86% to about 95% by weight of a first acrylate monomer of the general formula

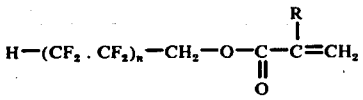

wherein R is hydrogen or methyl and $n$ is 1 to 4, from 5 to 14% by weight of a high molecular weight fluorocarbon polymer, from 0.1 to 5% by weight of a second acrylate monomer selected from hydroxyalkyl, epoxyalkyl, and glycerol acrylates and methacrylates and mixtures thereof and from 0.1 to 5% by weight of a free radical polymerization catalyst, said binder being the sole flame retardant component of said composition.

11. The cured composition of claim 4.

12. The cured composition of claim 6.

* * * * *